US005801344A

United States Patent [19]

Herold

[11] Patent Number: 5,801,344

[45] Date of Patent: Sep. 1, 1998

[54] SOUND ATTENUATOR WITH THROAT TUNER

[75] Inventor: Andrew J. Herold, Bloomington, Ind.

[73] Assignee: Arvin Industries, Inc., Columbus, Ind.

[21] Appl. No.: 805,092

[22] Filed: Feb. 24, 1997

Related U.S. Application Data

[63] Continuation of Ser. No. 516,281, Aug. 17, 1995, abandoned.

[51] Int. Cl.[6] ..... F01N 1/08

[52] U.S. Cl. ..... 181/272; 181/265; 181/266

[58] Field of Search ..... 181/265, 266, 181/269, 272, 274, 282, 228

[56] References Cited

U.S. PATENT DOCUMENTS

| | | | |
|---|---|---|---|
| 1,490,957 | 4/1924 | Birger . | |
| 1,760,557 | 5/1930 | Bourne . | |
| 2,124,489 | 7/1938 | Jupp . | |
| 2,297,046 | 9/1942 | Hurlock . | |
| 3,104,734 | 9/1963 | Ludlow et al. . | |
| 3,104,735 | 9/1963 | Ludlow et al. . | |
| 3,114,432 | 12/1963 | Ludlow et al. . | |
| 3,263,772 | 8/1966 | Irwin et al. . | |
| 3,396,812 | 8/1968 | Wilcox et al. . | |
| 3,415,336 | 12/1968 | Arthur et al. . | |
| 3,415,338 | 12/1968 | McMillan . | |
| 3,434,199 | 3/1969 | Arthur et al. . | |
| 3,648,803 | 3/1972 | Heath et al. . | |
| 3,655,011 | 4/1972 | Willett . | |
| 3,744,589 | 7/1973 | Mellin . | |
| 3,794,138 | 2/1974 | Heath et al. . | |
| 3,827,531 | 8/1974 | Hansen | 181/265 |
| 4,137,993 | 2/1979 | Rutt | 181/282 |
| 4,172,508 | 10/1979 | Moss et al. | 181/272 |
| 4,263,981 | 4/1981 | Weiss et al. . | |
| 4,281,741 | 8/1981 | Blaser et al. . | |
| 4,779,415 | 10/1988 | Richardson et al. . | |
| 4,930,597 | 6/1990 | Udell . | |
| 4,961,314 | 10/1990 | Howe et al. . | |
| 5,009,065 | 4/1991 | Howe et al. . | |
| 5,048,287 | 9/1991 | Howe et al. . | |
| 5,147,987 | 9/1992 | Richardson et al. . | |

FOREIGN PATENT DOCUMENTS

| | | |
|---|---|---|
| 356018 | 7/1922 | Germany . |

*Primary Examiner*—Khanh Dang
*Attorney, Agent, or Firm*—Barnes & Thornburg

[57] ABSTRACT

A double throat tuner including a second conduit concentric to a first conduit which connects the gas flow to a first volume tuning chamber having a first effective volume. The radial difference between the first and second conduits and the length of overlap of the first and second conduits in combination with the effective volume of the first tuning chamber attenuates a preselective frequency of sound. This attenuation is for a specific frequency range in addition to the overall attenuation of the complete system including a plurality of conduits serially connected by a respective chamber.

31 Claims, 6 Drawing Sheets

SOUND ATTENUATOR WITH THROAT TUNER

This is a continuation of application Ser. No. 08/516,281, filed Aug. 17, 1995, now abandoned.

This invention relates generally to sound attenuators, for example, engine exhaust noise mufflers or silencers, and more particularly, to acoustic attenuators that are acoustically coupled to engine exhaust pipes to attenuate engine exhaust noise.

Reducing vehicular noise produced by an internal combustion engine requires an easily constructed, compact, and lightweight noise reduction apparatus. In addition, such a noise reduction apparatus should attenuate low frequency long wavelength noise commonly emitted by internal combustion. In conventional internal combustion engines, hot exhaust gasses produced by combustion of fuel within an internal combustion engine are exhausted into an exhaust pipe that carries away the heated exhaust gasses. Noise produced and carried by such gasses has a wide frequency range, typically from about 30 Hz to about 5,000 Hz. The lower range of such frequencies, typically those sound frequencies below 200 Hz, are the most difficult to attenuate with conventional baffled sound mufflers. Although conventional sound mufflers adequately attenuate high frequency noise, attenuating low frequency, long wavelength, exhaust gas noise without the use of bulky and cumbersome baffle plates, sound absorbent chambers, or sound absorbing materials, is both expensive and difficult.

Absorbing, entrapping, or dissipating sound are not the only ways to reduce sound levels. For example, one method of reducing sound relies on the well-known wave phenomenon of destructive interference, produced by interaction of out of phase sound waves. Destructive interference can be demonstrated in an air column in a chamber closed at one end. Such a chamber acoustically resonates at wavelengths that depend upon the length of the air column. If a sound source producing sound at these wavelengths is acoustically coupled to the chamber, the energy of acoustic vibration can be transferred with high efficiency to the chamber. If the effective sound transmission path length of the air column (corresponding to the length of the air column) is selected to be about one-quarter the wavelength of the transferred sound, the sound wave is reflected backward at the chamber end, reversing its phase 180° to destructively interfere with incoming sound waves. Since vehicular engine noise generally is produced at high amplitudes only at certain wavelengths, sound reduction based on resonant coupling of a sound source to an appropriately configured closed end chamber that reverses the phase of reflected, outgoing sound waves to destructively interfere with incoming sound waves can be effectively used to attenuate engine noise.

However, one difficulty with using conventional quarter wavelength silencing elements is the long length of these elements. The length of the silencing element is linearly related to the length of a chamber or tube required to suppress low frequency (e.g. less than 500 Hz) noise. The lower the frequency to be attenuated, the longer the required length of the elongated single tube. For example, a quarter wavelength tube turned to attenuate 100 Hz noise would have a length of about 0.86 meters.

Since a quarter wave tube of this length is much too long for most vehicular applications, vehicle manufacturers have commonly avoided using conventional quarter wavelength silencing elements. Consequently, conventional mufflers have been provided with Helmholtz resonators, volume resonators, plenum chambers, sound dampening materials, or other sound attenuation devices to reduce engine noise emission. Unfortunately, although these other types of conventional sound reduction systems generally provide significant reduction in high frequency engine noise, they are not as effective in attenuating low frequency engine noise as quarter wavelength silencing elements.

A typical example of prior art designs are illustrated in FIGS. 1, 2 and 3 and are to be discussed more fully below. FIG. 1 shows a flow through design wherein the gas flow enters inlet 30 of conduit 32 and continued via conduit 34 to chamber 24, through conduit 36 to chamber 20 and finally exiting through conduit 38 to outlet 40. The length of the conduits 34, 36 and 38 are uniquely selected as is the tuning chambers 20 and 24.

A Helmholtz design of FIG. 2 includes the gas flow through inlet 70 through conduit 72 and 74, chamber 64, conduit 76, chamber 60, and conduit 78 to exit through outlet 80. In addition to this flow-through segment of the gas flow, a portion enters chamber 66 through conduit or throat 82. The chamber 66 is a Helmholtz chamber or a volume resonator where the volume is uniquely selected to attenuate a given frequency sound.

An annular throat design is illustrated in FIG. 3. The gas flows through inlet 93 through conduit 95 and exiting outlet 94. An opening 97 in conduit 95 provides a gas flow through the annular space between conduit 96 and 95 and into volume 92. The length of the overlap of conduits 95 and 96 as well as the difference in diameter defines the attenuating characteristic of the annular throat tuning in addition to the attenuation afforded by volume 92.

A typical flow through attenuator is illustrated in U.S. Pat. Nos. 4,930,597 and 5,009,065. Principle of volume and length attenuators as well as quarter length concentric attenuators, are described in U.S. Pat. No. 2,297,046.

Continual efforts are underway to reduce the size of the tuning chamber 24 in FIG. 1 and also the tuning chamber 66 in FIG. 2. Modification of the chamber 66 in FIG. 2 is more difficult because it drastically effects the frequency response of this volume resonator. The goal is to receive the same sound and pass through levels of prior designs while reducing the tuning volumes.

Thus, it is an object of the present invention to provide a sound attenuator which has less volume while maintaining sound and pass through levels.

These and other objects are achieved by providing a second conduit concentric to a first conduit which connects the gas flow to a first volume tuning chamber having a first effective volume. This, in effect, is a double throat tuner. The second conduit has an inlet connected to the first tuning chamber and outlet connected to a second tuning chamber. Thus, the inlet of the second conduit is adjacent the outlet of the first conduit in the first tuning chamber. The radial difference between the first and second conduits and the length of overlap of the first and second conduits in combination with the effective volume of the first tuning chamber attenuates a preselected frequency of sound. This attenuation is for a specific frequency range in addition to the overall attenuation of the complete system including a plurality of conduits serially connected by a respective chamber. Tests have shown that a greater percentage of sound pulse wave attenuation is achieved versus a standard Helmholtz or volume attenuator system.

While the first or interior conduit is solid over its length that is concentric of the second conduit, the second conduit may include peripheral openings or be solid also. The first and second conduits extend into the first chamber the same length, or at least the second conduit does not extend any greater than the first conduit into the first chamber. A third conduit fluidly interconnects the second chamber which is the chamber, in which the second conduit has an outlet, to the housing outlet so as to reverse the fluid flow by 180° from the fluid flow direction of the second conduit. A fourth conduit connects the second chamber to a third chamber and the third conduit has an inlet connected to the third chamber.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
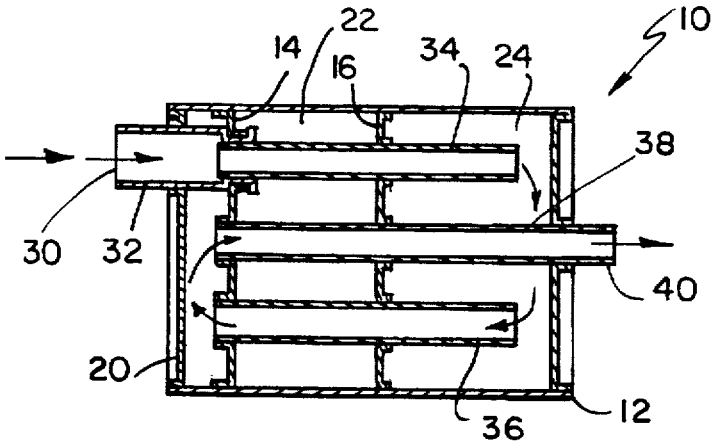
PRIOR ART FIG. 1
FIG. 1 is a schematic diagram of a flow through attenuator of the prior art.
Figure 2:
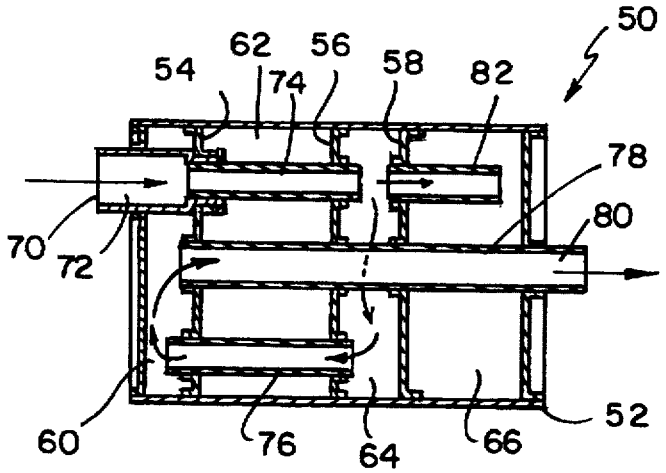
PRIOR ART FIG. 2
FIG. 2 is a schematic representation of a Helmholtz or volume attenuator of the prior art.
Figure 3:
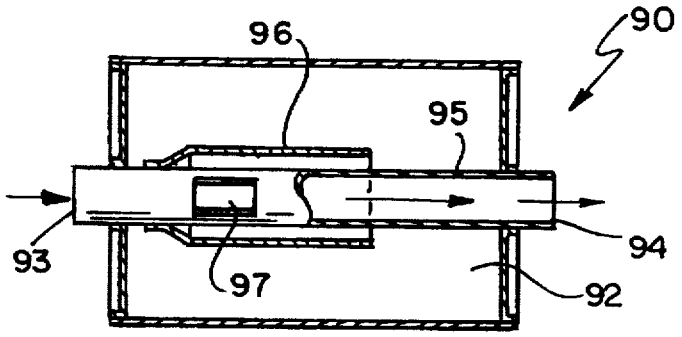
PRIOR ART FIG. 3
FIG. 3 is a schematic representation of an annular throat attenuator of the prior art.
Figure 4:
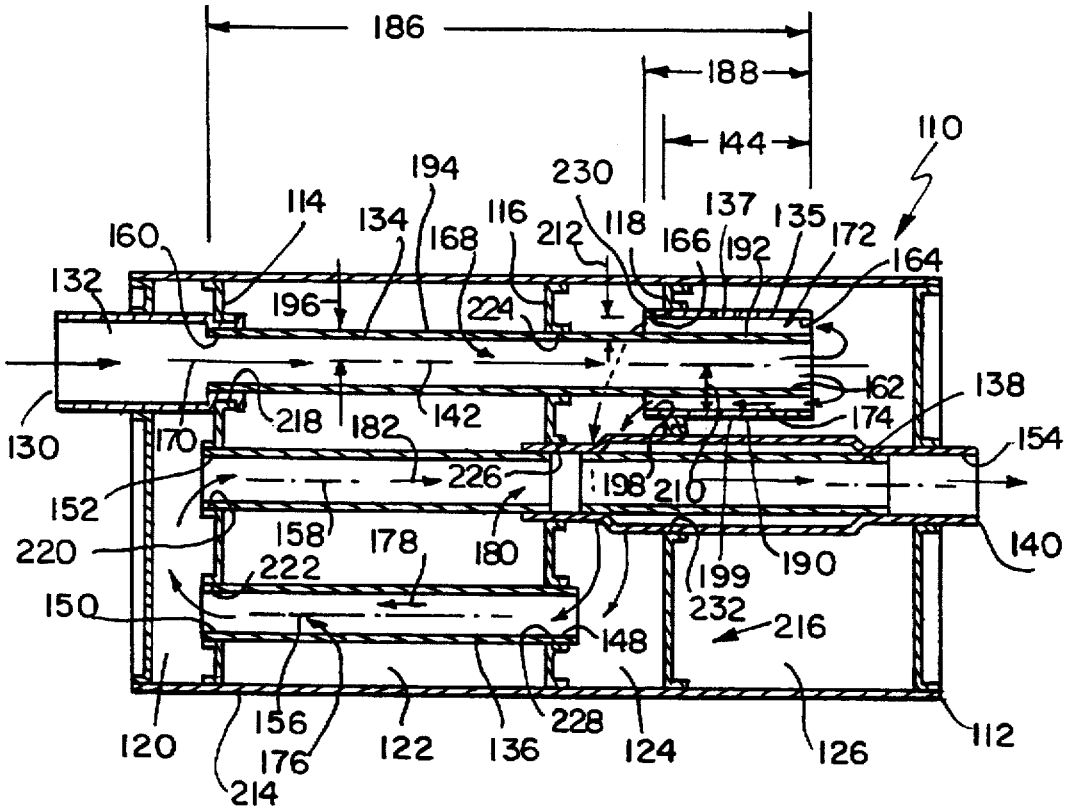
FIG. 4 is a schematic representation of an attenuator incorporating the principles of the present invention.

Before describing an attenuator incorporating the principles of the present invention of FIG. 4, a further explanation of the prior art of FIGS. 1–3 will be provided. The flow through attenuator 10 of FIG. 1 includes the housing 12 and interior walls 14 and 16 dividing the interior into chambers 20, 22 and 24. The serial connected conduits includes inlet 30 at inlet portion 32 connected to conduit 34 having an outlet in chamber 24. Conduit 36 has an inlet in chamber 24 and outlet in chamber 20 and the final conduit 38 has an inlet in chamber 20 and an outlet as the attenuator outlet 40. Chambers 20 and 24 are considered tuning chambers as is well known.

Although the conduits 34, 36 and 38 are shown as solid, they may include peripheral openings or louvers (not shown) as is well known in the art and illustrated in the above mentioned patents.

A Helmholtz tuned attenuator 50 is illustrated in FIG. 2. The housing 52 includes interior walls 54, 56 and 58 dividing into chambers 60, 62, 64 and 66. The inlet 70 is on inlet conduit 72 which is connected to conduit 74 having an outlet in chamber 64. Conduit 76 connects chamber 64 to chamber 60. A final conduit 78 connects chamber 60 to the attenuator outlet 80. A conduit or throat 82 connects chamber 64 to chamber 66. Chamber 66 is a volume attenuator or Helmholtz attenuator wherein the volume determines the frequency of the signal being attenuated.

Although the conduits 74, 76 and 78 are shown as solid, they may include peripheral openings or louvers as is well known in the art and illustrated in the above mentioned patents.

An annular throat attenuator 90 is illustrated in FIG. 3. It includes a housing 91 having an interior chamber 92. A conduit 95 has an inlet 93 and an outlet 94. A conduit 96 is concentric to conduit 95 and receives gasses through an opening 97 in the conduit 95. The gas from conduit 96 exits into closed chamber 92. The length of the conduit 96 and the cross section in the annular area between conduits 95 and 96 define the attenuating frequency of the annular throat attenuator in addition to the attenuation provided by volume 92. Although the conduit 95 is shown as solid, it may include peripheral openings or louvers (not shown) as is well known in the art and illustrated in the above mentioned patents; except for those portions of overlap with conduit 96.

The sound attenuator 110 according to the present invention and as illustrated in FIG. 4, includes a housing 112. Housing 112 includes an outer shell 214 and a conduit support 216 coupled to outer shell 214 as shown in FIG. 4. Conduit support 216 includes baffles or interior walls 114, 116 and 118 divide the housing into chambers 120, 122, 124 and 126. Interior wall 114 is formed to include first, second, and third conduit-receiving apertures 218, 220, 222, interior wall 116 is formed to include first, second, and third conduit-receiving apertures 224, 226, 228, and interior wall 118 is formed to include first and second conduit-receiving apertures 230, 232 as shown in FIG. 4. Third conduit-receiving aperture 228 formed in interior wall 116 may also be referred to as an outlet aperture 228. Sound attenuator 110 further includes conduits 134, 135, 136, 138 as shown in FIG. 4. Conduit 134 extends through first conduit-receiving apertures 218, 224, 230 formed in interior walls 114, 116, 118, respectively, and conduit 135 extends through first conduit-receiving aperture 230 formed in interior wall 118 so that conduit 135 engages interior wall 118 and conduit 134 is spaced apart from interior wall 118 as shown in FIG. 4. Conduit 136 extends through third conduit-receiving apertures 222, 228 formed in interior walls 114, 116, respectively, and conduit 138 extends through second conduit-receiving apertures 220, 226, 232 formed in interior walls 114, 116, 118, respectively, as shown in FIG. 4. The inlet 130 is on an inlet conduit 132 connected to conduit 134 having an outlet in chamber or first volume tuning chamber 126. A concentric conduit 135 has an inlet in chamber 126 and an outlet in chamber 124. The conduits 134 and 135 extend along a first conduit axis 142 generally the same distance into chamber 126, preferably, conduit 135 extends no further into the chamber 126 than does conduit 134 as shown in FIG. 4. Conduits 134 and 135 extend into chamber 126 a distance 144 along first conduit axis 142 as shown in FIG. 4. Conduit 136 extends along a second conduit axis 156 and connects chamber 124 to chamber 120 and conduit 138 extends along a third conduit axis 158 through chamber 126 and connects chamber 120 to attenuator outlet 140 as shown in FIG. 4. Conduit 136 includes an inlet 148 communicating with chamber 124 and an outlet 150 communicating with chamber 120 as shown in FIG. 4. Conduit 138 includes an inlet 152 communicating with chamber 120 and an outlet 154 defining attenuator outlet 140 as shown in FIG. 4. Conduit axes 142, 156, and 158 are parallel as shown in FIG. 4.

Conduit 134 includes an inlet 160 connected to inlet conduit 132 and an outlet 162 communicating with chamber 126 as shown in FIG. 4. Conduit 135 includes an inlet 164 communicating with chamber 126 and an outlet 166 communicating with chamber 124 as shown in FIG. 4. Exhaust gas passes through the various conduits 132, 134, 135, 136, 138 and chambers 120, 122, 124, 126 as it travels between attenuator inlet 130 and attenuator outlet 140 as shown by the directional arrows in FIG. 4. Conduit 134 defines a first flow passageway 168 through which the exhaust gas travels from inlet conduit 132 to chamber 126 in direction 170 as shown in FIG. 4. The exhaust gas then travels from chamber 126 through a second flow passageway 172 defined between conduit 134 and conduit 135 into chamber 124 in direction 174 as shown in FIG. 4. Conduit 136 defines a third flow passageway 176 through which the exhaust gas then travels from chamber 124 to chamber 120 in direction 178 as shown in FIG. 4. The exhaust gas passes in direction 182 through a fourth flow passageway 180 defined by conduit 138 as it passes from chamber 120 to attenuator outlet 140 as shown in FIG. 4. Directions 170 and 182 are substantially parallel to each other and approximately 180° opposed to directions 174 and 178. Conduit 134 includes a first length 186 along first conduit axis 142 and conduit 135 includes a second length 188 along first conduit axis 142 that is less than first length 186 as shown in FIG. 4.

Although the conduits 134, 136 and 138 are shown as solid, they may include peripheral openings or louvers as is well known in the art and illustrated in the above mentioned patents;, except 134 must be solid where it is overlapped by conduit 135.

Conduit 135 includes an overlap section 190 of length 188 along first conduit axis 142 as shown, for example, in FIG. 4. Length 188 can be referred to as an overlap length because length 190 is the length that conduit 135 extends over an overlapped section 192 of conduit 134 as shown, for example, in FIG. 4. In preferred embodiments of the present invention, the length 188 of overlap section 190 is the same as or no greater than length 188 of conduit 135 because the distance 146 that conduit 135 extends into chamber 126 is equal to the distance 144 that conduit 134 extends into chamber 126, as shown in FIG. 4. Conduit 134 includes an outer surface 194 at a first radius 196 from first conduit axis 142 and conduit 135 includes an inner surface 198 at a second radius 210 from first conduit axis 142 as shown, for example, in FIG. 4. The difference between second radius 210 and first radius 196 is defined as a conduit radial difference 212 as shown in FIG. 4.

Outer surface 194 of conduit 134 may be formed to include peripheral openings or louvers (not shown). However, outer surface 194 of conduit 134 should be solid, i.e. not formed to include any peripheral openings or louvers, in overlapped section 192 as shown, for example, in FIG. 4. In the illustrated embodiment of the present invention, surface 198 of conduit 135 includes a peripheral opening or louver 137 as shown in FIG. 4. However, in alternative embodiments, conduit 135 may be formed to not include peripheral openings or louvers.

The frequency of attenuation of the double throat or overlapped portions of conduits 135 and 134, plus the attenuating volume 126 is defined by formula (1) as follows:

$$f=c\sqrt{\frac{ThA}{V\left(O_L+\frac{\Pi R}{2}\right)}}$$

f=frequency of attenuation;

c=the speed of sound at the measurement temperature;

ThA—cross-sectional area of the annulus between the overlapping conduits 134 and 135;

V=the volume of chamber 126 minus the volume of conduit 138 passing therethrough;

$O_L$=the overlap length of conduits 134 and 135;

R=is the effective radius of the throat area.

If the objectionable frequency to be attenuated is known as well as the other variables of equation 1 except for the overlap length, then the overlap length can be determined for that frequency according to formula (2) as follows:

$$O_L=\left(\frac{c}{f}\right)^2\frac{ThA}{V}-\frac{\Pi R}{2}$$

For example, if 100 Helmholtz at 200° F. is the desired frequency to be attenuated, which will be discussed with respect to FIGS. 5 and 6, then the volume V=299 inches cubed. If the outside radius of 134 is 1.5 inches and the inside radius of conduit 135 is 2.4 inches, then the differential area of ThA equals 2.77 inches squared. This area has an effective radius R=0.933 inches. The speed of sound C at 200° F. is 2405 inches per second. Using equation 2, this would produce an overlap length $O_L$32 3.937 or approximately 100 millimeters. Thus, it can be seen that the tuning of chamber 126 and the double throat conduits 134 and 135 are related to the volume of 126, the differential annular area of the throats as well as the overlap length of the throats.

Figure 5:
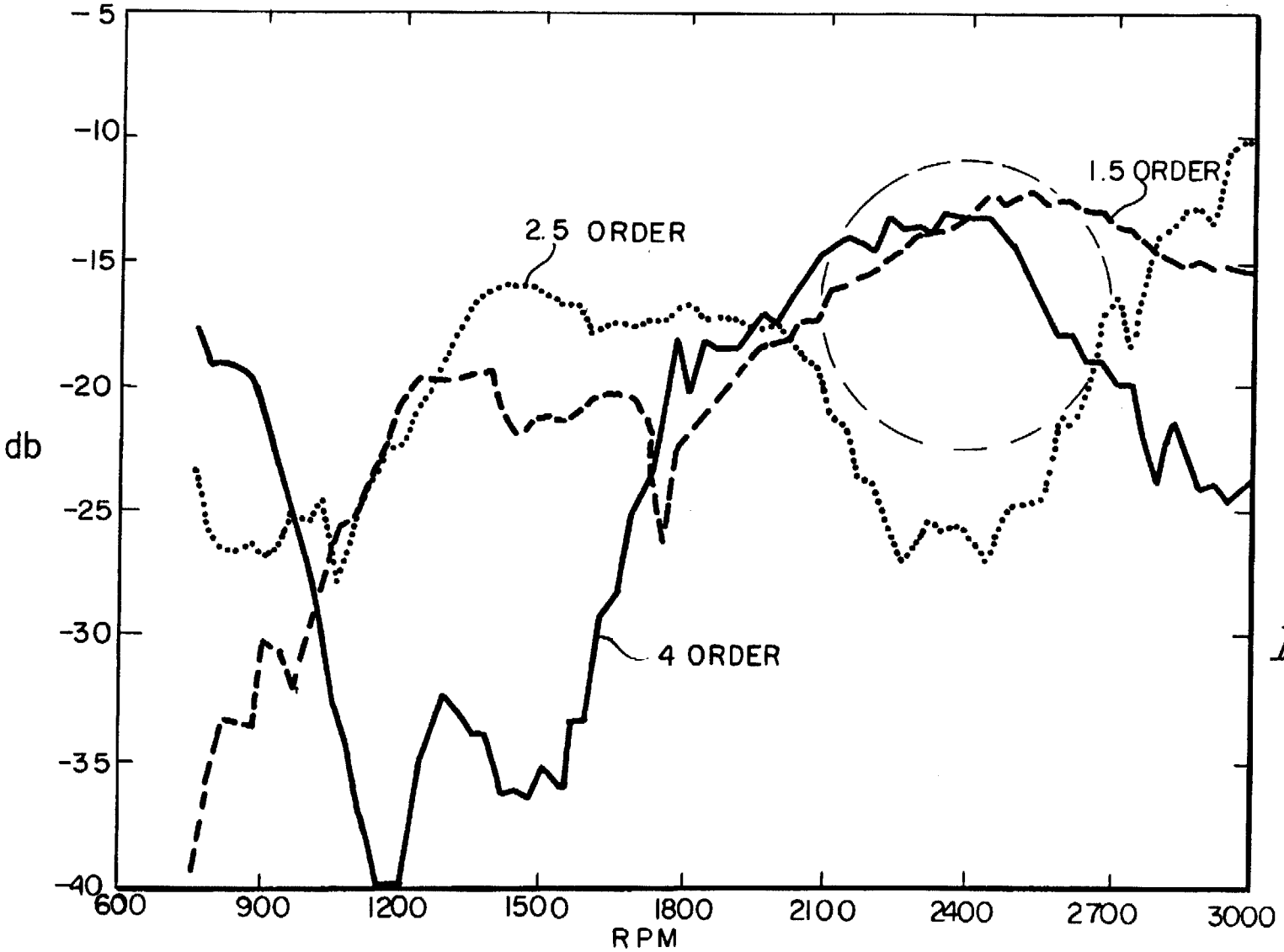
FIG. 5 is a graph of an engine's rotational velocity versus decibel level for selected orders for an attenuator of the present invention illustrated in FIG. 4.
Figure 6:
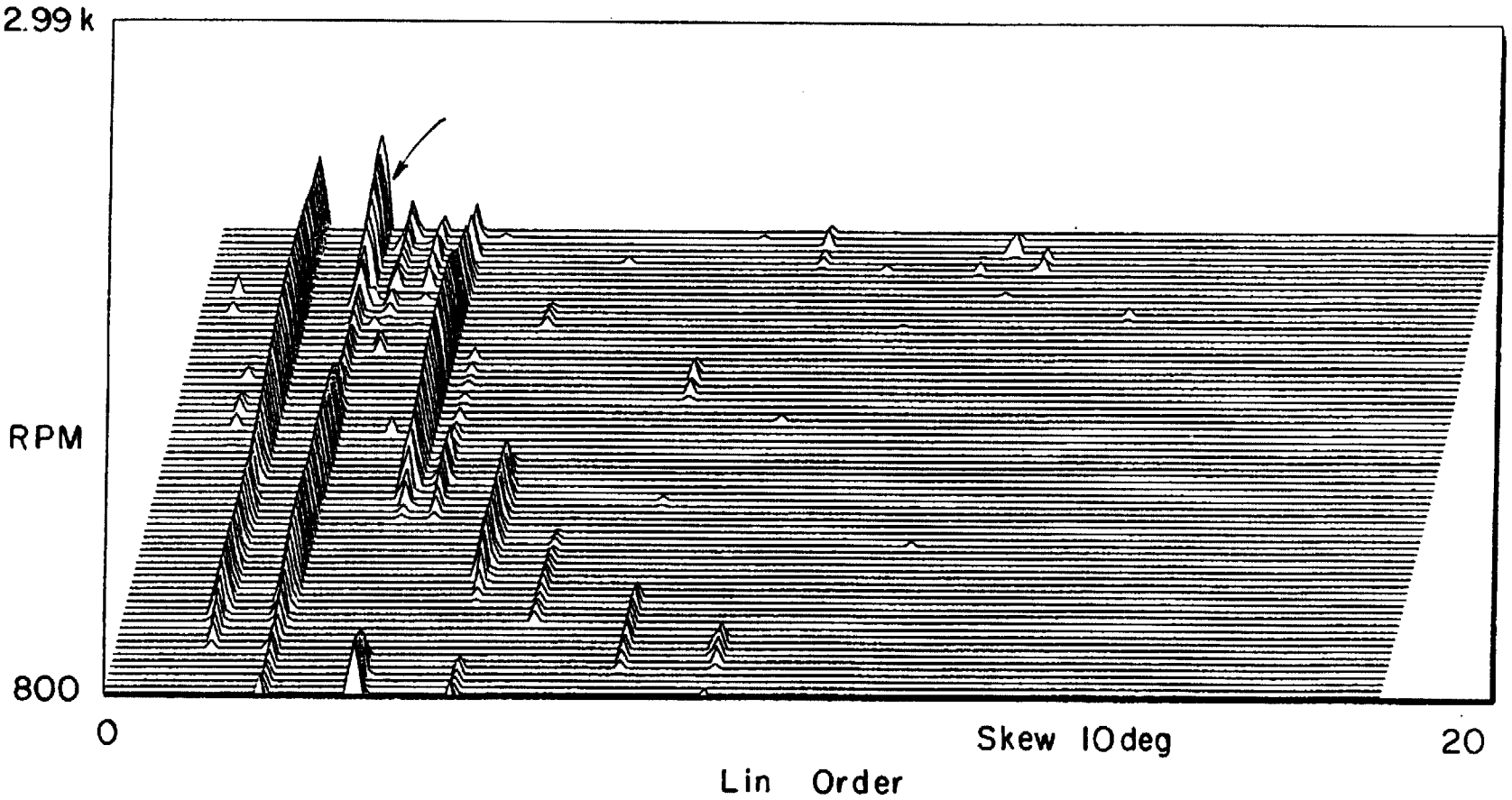
FIG. 6 is a graph of the engine's rotational velocity versus the linear order for FIG. 5.

Referring to FIG. 5, the area of the tuning of the present device for 100 Hertz is at 2400 rpms. For an 8 cylinder engine at 160 Hertz is equal to 100 Hertz hot at 200° F. The orders 1.5, 2.5, and 4 and the overall signals are shown only. These orders relate to the rows or orders from the diagram of FIG. 6. The present device as designed according to the perimeters above, causes substantial reduction in the decibel level for the 2.5 order at 100 Hertz. It should be noted that the other orders 8, 5.5 and 12 have not been illustrated in FIG. 5 for sake of clarity.

Figure 7:
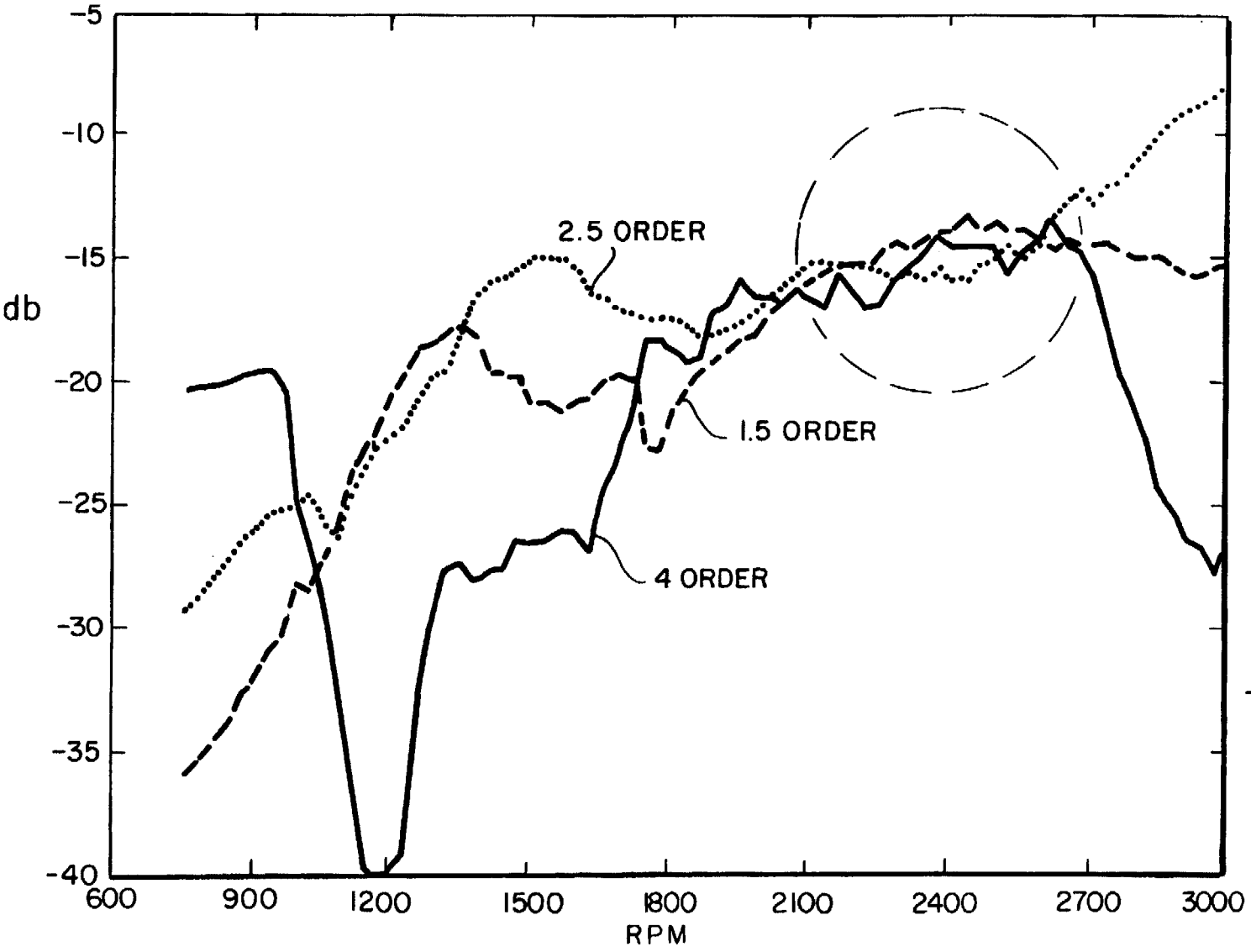
FIG. 7 is a diagram of the engine's rotational velocity versus decibel levels for the same orders as FIG. 5 for the Helmholtz design of FIG. 2 of the prior art.

A comparison of the same orders for the Helmholtz design having the same design perimeters using the Helmholtz of FIG. 2 is shown in FIG. 7 and shows a decrease in the present design of approximately 10 decibels at the 2400 rpm level for the 2.5 order. Although the other orders are effected because of the overall gas flow, there is no significant difference other than that of the 2.5 order.

Figure 8:
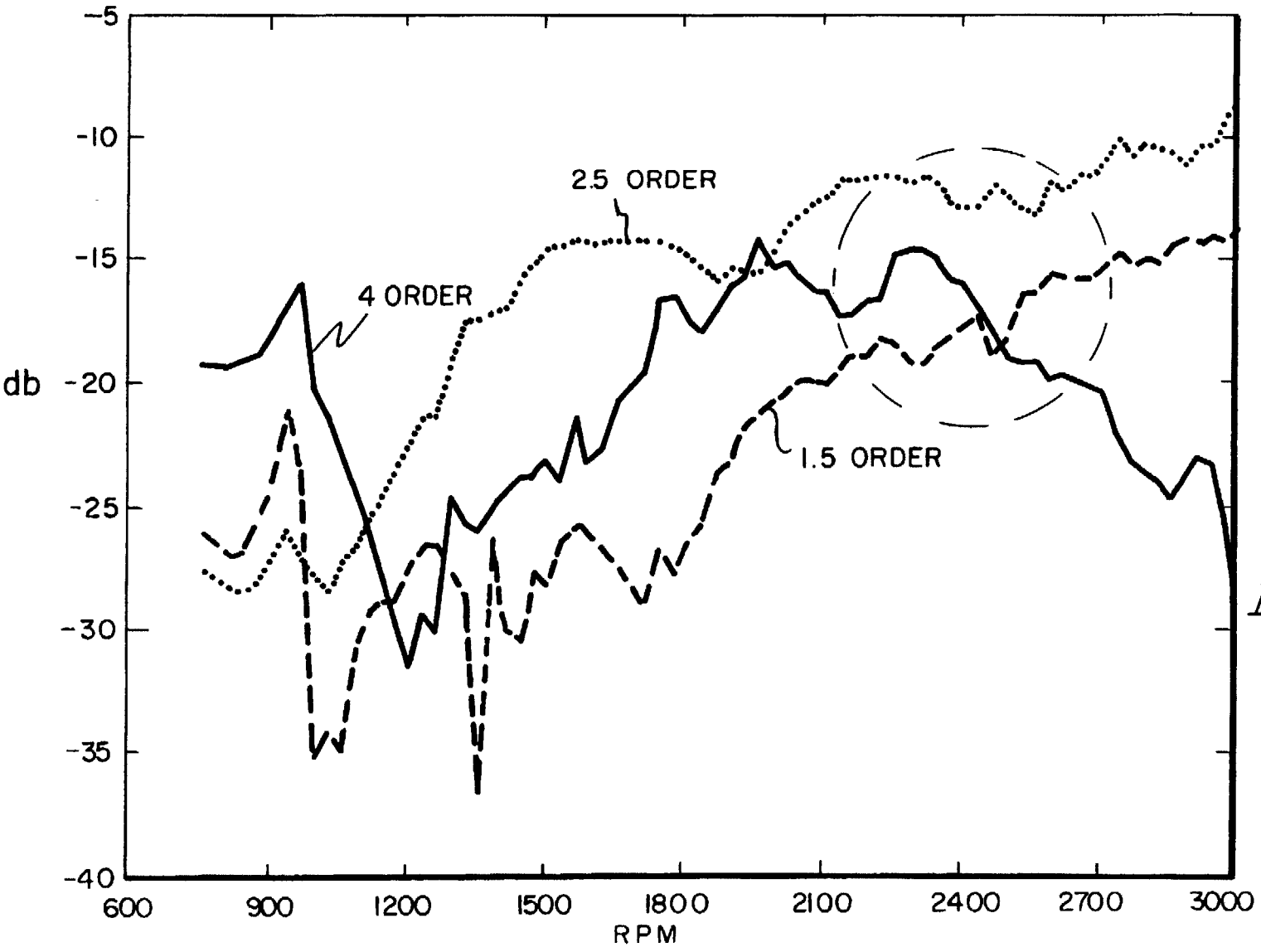
FIG. 8 is a diagram of the engine's rotational velocity versus decibel levels for the same orders as FIG. 5 for a flow through attenuator of FIG. 1 of the prior art.

The graph of FIG. 8 shows the same orders for a flow through tuner design according to the prior art in FIG. 1. Again, there is improvement of almost 13 decibels at 2400 rpm for the 2.5 order. As illustrated in FIG. 8, the 1.5 order is 4 decibels higher in the present invention.

Therefore, the double throat in combination with the Helmholtz or volume attenuator allows very specific frequencies to be additionally attenuated without a major modification of the overall attenuator or increasing its length or volume by using the double throat attenuator. As compared to a standard volume or Helmholtz attenuator, the ability to flow gas therethrough instead of offering it as a dead end chamber allows the Helmholtz volume attenuator to be more effective to reduce a greater percentage of sound pulse waves. The cross-sectional area of the annulus between the two throats 134 and 135 should be sufficient to maximize the gas flow therethrough and minimize pressure drops. As discussed previously, the conduit 134 is solid over the length of overlap with conduit 135.

Early experiments have shown that some peripheral openings or louvers, shown as 137, may be provided in the second throat or conduit 135. The effect of such louver is to reduce the back pressure impact.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A sound attenuating apparatus comprising:

a housing including an inlet, an outlet, a first chamber having an effective volume, and a second chamber;

a first conduit positioned to lie in said housing along a first conduit axis, said first conduit having a passageway, an inlet opening into the passageway, and an outlet opening into the passageway, said outlet of said first conduit communicating with said first chamber so that exhaust gas passses through the outlet of the first conduit into the first chamber; and a second conduit positioned to lie in said housing along said first conduit axis around said first conduit, the second conduit having a passageway, a first end defining an inlet opening into the passageway so that exhaust gas passes from the first chamber into the inlet of the second conduit, and a second end spaced apart from the first end and defining an outlet opening in the passageway so that exhaust gas passes through the outlet of the second conduit into said second chamber, the first end being situated in the first chamber and the second end being situated in the second chamber.

2. The apparatus of claim 1, wherein said second conduit includes an outer surface facing away from said first conduit and having at least one peripheral opening.

3. The apparatus of claim 1, further comprising a third conduit positioned to lie in the housing and extend along a second conduit axis through said first volume tuning chamber and the third conduit having a passageway and an outlet opening into the passageway and defining the outlet of the housing so that exhaust gas passes from the third conduit through the outlet of the housing.

4. The apparatus of claim 3, wherein the housing further includes a third chamber, the apparatus further includes a fourth conduit positioned to lie in the housing and extend along a third conduit axis to connect said second chamber to said third chamber, the fourth conduit has a passageway, an inlet opening into the passageway and communicating with the second chamber so that exhaust gas passes from the second chamber into the inlet of the fourth conduit, and an outlet opening into the passageway and communicating with the third chamber so that exhaust gas passes through the outlet of the fourth conduit into the third chamber, and said third conduit has a passageway and an inlet opening into the passageway and communicating with said third chamber so that exhaust gas passes from the third chamber into the inlet of the third conduit.

5. The apparatus of claim 4, wherein said third conduit extends through said second chamber.

6. The apparatus of claim 3, wherein said first, second, and third conduit axes are parallel.

7. The apparatus of claim 1, wherein said second conduit extends over a portion of the first conduit a distance, the second conduit includes an overlap section having an overlap length along the first conduit axis which defines the distance said second conduit extends over said first conduit, said first conduit includes an overlapped section which defines the portion of said first conduit overlapped by said second conduit, and said overlapped section of said first conduit includes a solid outer surface facing toward said second conduit.

8. The apparatus of claim 7, wherein said second conduit includes an outer surface facing away from said first conduit and having at least one peripheral opening.

9. The apparatus of claim 1, wherein said first conduit extends into said first volume tuning chamber along said first conduit axis a first distance and said second conduit extends into said first volume tuning chamber along said first conduit axis a second distance that is equal to said first distance.

10. The apparatus of claim 1, wherein said first conduit extends into said first volume tuning chamber along said first conduit axis a first distance and said second conduit extends into said first volume tuning chamber along said first conduit axis a second distance that is no greater than said first distance.

11. The apparatus of claim 1, wherein said first conduit defines a first flow passageway means for receiving flow in a first direction, said second conduit defines a second flow passageway means for receiving flow in a second direction, and further comprising a third conduit positioned to lie in the housing, the third conduit defining a third flow passageway means for receiving flow in a third direction that is 180° opposed to said second direction and including an inlet communicating with said second chamber and an outlet defining said outlet of said housing.

12. The apparatus of claim 11, wherein the housing further includes a third chamber, the apparatus further includes a fourth conduit positioned to lie in the housing and configured to connect said second chamber to said third chamber, the fourth conduit has a passageway, an inlet opening into the passageway and communicating with the second chamber so that exhaust gas passes from the second chamber into the inlet of the fourth conduit, and an outlet opening into the passageway and communicating with the third chamber so that exhaust gas passes through the outlet of the fourth conduit into the third chamber, and said third conduit has a passageway and an inlet opening into the passageway and communicating with said third chamber so that exhaust gas passes from the third chamber into the inlet of the third conduit.

13. The apparatus of claim 1, wherein said first conduit includes an outer surface at a first radius from said first conduit axis, said second conduit includes an inner surface at a second radius from said first conduit axis that is greater than said first radius, wherein the difference between said second radius and said first radius is a conduit radial difference, said second conduit includes an overlap section having an overlap length along the first conduit axis which defines the distance along said first conduit axis said second conduit extends over said first conduit, and said conduit radial difference, said overlap length, and said effective volume of said first volume tuning chamber attenuate a preselected frequency of sound.

14. The apparatus of claim 1, wherein the housing includes an outer shell and a conduit support coupled to the outer shell and the first and second conduits are coupled to at least one of the outer shell and conduit support.

15. The apparatus of claim 14, wherein the second conduit is coupled to the conduit support.

16. The apparatus of claim 14, wherein the conduit support includes a baffle coupled to the outer shell and configured to separate the first and second chambers.

17. The apparatus of claim 14, wherein the housing further includes a third chamber and the conduit support includes first and second baffles coupled to the outer shell and configured to define first, second, and third chambers.

18. The apparatus of claim 14, wherein the conduit support is formed to include a conduit-receiving aperture and the first and second conduits extend through the conduit-receiving aperture formed in the conduit support.

19. The apparatus of claim 14, wherein the outlet of the first conduit is spaced apart from the conduit support a first distance and the inlet of the second conduit is spaced apart from the conduit support a second distance that is equal to the first distance.

20. The apparatus of claim 14, wherein the second conduit engages the conduit support and the first conduit is spaced apart from the conduit support.

21. The apparatus of claim 1, wherein the outlet of the first conduit is situated in the first chamber.

22. The apparatus of claim 1, wherein the first conduit extends through the second chamber.

23. A sound attenuating apparatus comprising a housing including an outer shell, a conduit support coupled to the other shell and formed to include a conduit-receiving aperture, an inlet, an outlet, and a chamber having an effective volume and first and second conduits positioned to lie in said housing, said first conduit having a passageway, an inlet opening into the passageway, an outlet opening into the passageway, and a first length, said second conduit having a passageway, an inlet opening into the passageway adjacent to said outlet of said first conduit, an outlet opening into the passageway, and a second length that is less than the first length, said second conduit being positioned to lie around said first conduit, and said outlet of said first conduit and said inlet of said second conduit being spaced-apart from the conduit support and situated within said chamber so that exhaust gas passes from the outlet of the first conduit into the chamber and from the chamber into the inlet of the second conduit.

24. A sound attenuating apparatus having a longitudinal axis, the sound attenuating apparatus comprising a housing including an inlet, an outlet, an outer shell, and first and second interior walls that cooperate with the outer shell to define first, second, and third chambers, the second interior wall being formed to include an outlet aperture, a first conduit positioned to lie in the housing along a first conduit axis, said first conduit having a passageway an inlet opening into the passageway communicating with the inlet of the housing so that exhaust gas passes from the inlet of the housing into the inlet of the first conduit, and an outlet opening into the passageway communicating with the first chamber so that exhaust gas passes through the outlet of the first conduit into the first chamber, and a second conduit positioned to lie in the housing along the first conduit axis around the first conduit, the second conduit having a passageway, an inlet opening into the passageway and communicating with said first chamber so that exhaust gas passes from the first chamber into the inlet of the second conduit, and an outlet opening into the passageway communicating with said second chamber so that exhaust gas passes through the outlet of the second conduit into the second chamber, and the first conduit axis being spaced apart from the outlet aperture formed in the second interior wall.

25. The sound attenuating apparatus of claim 24, wherein the longitudinal axis is positioned to lie between the outlet of the second conduit and the outlet aperture formed in the second interior wall.

26. The sound attenuating apparatus of claim 24, wherein the first interior wall is formed to include a conduit-receiving aperture and the first and second conduits extend through the conduit-receiving aperture formed in the first interior wall.

27. The sound attenuating apparatus of claim 24, further comprising a third conduit positioned to lie in the housing and extend through the outlet aperture formed in the second interior wall along a second conduit axis, the third conduit having a passageway, an inlet opening into the passageway and communicating with the second chamber so that exhaust gas flows from the second chamber into the inlet of the third conduit, and an outlet spaced apart from the inlet, opening into the passageway, and communicating with the third chamber so that exhaust gas passes from the outlet of the third conduit into the third chamber, and the second conduit axis being spaced apart from the first conduit axis.

28. The sound attenuating apparatus of claim 27, further comprising a fourth conduit positioned to lie in the housing and extend along a third conduit axis and the fourth conduit having a passageway, an inlet opening into the passageway and communicating with the third chamber so that exhaust gas passes from the third chamber into the inlet of the fourth conduit, and an outlet spaced apart from the inlet, opening into the passageway, and communicating with the outlet of the housing so that exhaust gas passes from the passageway of the fourth conduit into the outlet of the housing.

29. The sound attenuating apparatus of claim 28, wherein the second interior wall is formed to include a conduit-receiving aperture and the fourth conduit extends through the conduit-receiving aperture formed in the second interior wall.

30. The sound attenuating apparatus of claim 28, wherein the first, second, and third conduit axes are parallel.

31. The sound attenuating apparatus of claim 28, further comprising a third interior wall formed to include first, second, and third conduit-receiving apertures, the first conduit extends through the first conduit-receiving aperture, the third conduit extends through the second conduit-receiving aperture, and the fourth conduit extends through the third conduit-receiving aperture.

* * * * *